US006834719B2

(12) United States Patent
Fritchley et al.

(10) Patent No.: US 6,834,719 B2
(45) Date of Patent: Dec. 28, 2004

(54) DRILLPIPE SUB

(75) Inventors: Keith Anthony Fritchley, Hucknall (GB); Michael Charles Spencer, Melton Mowbray (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 103 days.

(21) Appl. No.: 10/244,368

(22) Filed: Sep. 16, 2002

(65) Prior Publication Data

US 2003/0070802 A1 Apr. 17, 2003

(30) Foreign Application Priority Data

Oct. 12, 2001 (GB) ..... 0124646

(51) Int. Cl.[7] ..... E21B 33/16
(52) U.S. Cl. ..... 166/153; 166/192
(58) Field of Search ..... 166/192, 290, 166/289, 154, 153, 155, 291, 193, 194

(56) References Cited

U.S. PATENT DOCUMENTS 4,378,838 A * 4/1983 Ogden et al. ..... 166/153
4,671,358 A * 6/1987 Lindsey et al. ..... 166/291
4,706,747 A * 11/1987 Schneider ..... 166/153
4,893,684 A * 1/1990 Alexander ..... 175/65
5,036,922 A * 8/1991 Braddick ..... 166/383
6,196,311 B1 * 3/2001 Treece ..... 166/192

FOREIGN PATENT DOCUMENTS

| | | |
|---|---|---|
| EP | 0225145 A2 | 6/1997 |
| GB | 2126631 A | 9/1983 |
| GB | 2237046 A | 8/1990 |
| GB | 2331537 A | 11/1998 |

* cited by examiner

*Primary Examiner*—Frank Tsay
(74) *Attorney, Agent, or Firm*—Paul & Paul

(57) ABSTRACT

A drillpipe sub (30) comprises a shaft (32), a first frustoconical member (34) encircling, and fixedly mounted on, the shaft (32), and a second, opposed frustoconical member (36) encircling, and slidably mounted on, the shaft (32). The first frustoconical member (34) is bonded at its base (38) to the base (40) of the second frustoconical member (36).

13 Claims, 3 Drawing Sheets

DRILLPIPE SUB

BACGROUND OF THE INVENTION

The invention relates to a "sub", that is a device intended to lie or move within eg. a wellbore during operations aimed at extracting fossil fuels from subterranean formations.

The invention has particular, but not exclusive, relevance to a sub that is capable of being pumped in drilling fluid eg. within a length of drillpipe inserted into a wellbore. Other subs, to which the invention also relates, are pumpable eg. during drilling operations or along a cased wellbore that omits a drillpipe. For convenience all such subs are referred to herein as "drillpipe subs", although this term should not be construed as limiting the invention solely to subs intended for use within drillpipes.

It is often necessary when pumping fluids into and out of a well via the inside of a drillpipe to keep the fluids entirely or substantially separate from each other. One reason for requiring this is to create a fluid pressure difference between the ends of a sub, so that the sub travels in a desired direction along a length of drillpipe thereby conveying a body of fluid into the drillpipe without allowing it to mingle with other fluids therein.

For this and other fluid separation purposes it is known to employ a drillpipe sub, having one or more swab cups mounted thereon, within the drillpipe.

Another purpose of such subs is to utilise fluid pressure differentials across the swab cups, to convey equipment along the drillpipe.

A swab cup is typically a flexible, hollow frustum of a cone whose narrow end is in use pierced by the cylindrical body of a sub. The narrow end of the swab cup is sealingly secured about the sub body. The base of the frustum is in the uncompressed condition of slightly larger diameter than the inner diameter of a drillpipe.

A drillpipe sub 10 having four swab cups 12 mounted thereon is shown in FIG. 1. Each of the swab cups 12 is frustoconical and includes as its narrower end a sleeve 14. Each sleeve 14 is sealingly secured encircling the exterior of a sub body 16. When the sub 10 is within a drillpipe, frustoconical annular walls 18, that are made of a flexible material, extend outwardly from the respective seals 14 so that their peripheries lie adjacent the inner surface of the drillpipe.

In the FIG. 1 arrangement the swab cups each taper towards the downhole end of the sub. When fluid pressure (e.g. of drilling mud, etc) in the drillpipe acts on the uphole side of the sub, the free peripheries of the swab cups tend to approach and seal against the drillpipe wall thereby creating a pressure differential across the swab cups. The pressure differential pumps the sub in eg. a downhole direction along the drillpipe.

In such arrangements it is not always necessary for the swab cups to engage at their peripheries the inner surface of the drillpipe. For example when using a sub to transport equipment it is often sufficient, for the purpose of creating the pressure differential, for each swab cup periphery to provide a resistance to fluid flow from one side of the swab cups to the other.

One defect of the known swab cups is that they tend to fail when the sub is subjected to relatively low axial loads, such as arise when conveying equipment within a drillpipe.

In one mode of failure, the swab cups have been found to "flip" or turn inside out. For example, a swab cup for a drillpipe having an internal diameter of 70 mm (2.75") will turn inside out at a differential pressure of 689 kPa (100 psi), which effectively limits the axial load which may be applied to the drillpipe sub to 2668N (600 lbs). A larger swab cup for a drillpipe having a diameter of 108 mm (4.25") will turn inside out at a differential pressure of 172 kPa (25 psi) which effectively limits the total force which may be applied to the cup to 1334N (300 lbs).

SUMMARY OF THE INVENTION

In another mode of failure, the base of the cone frustum defined by each swab cup rotates relative to the drillpipe, as shown in FIG. 2. When the swab cups are used to seal the drillpipe such rotation breaks contact between the inner surface of the drillpipe and the swab cups, thereby breaking the seal. When the sub supporting the swab cups is used to convey equipment such rotation increases the clearance between the swab cups and the inner surface of the drillpipe, thereby reducing or even eliminating the above-mentioned pressure differential.

According to a first aspect of the invention there is provided a drillpipe sub comprising an elongate body member defining at least one outer periphery; a first, flexible, frustoconical member including a securing portion and a base portion that is radially spaced from the securing portion, the securing portion being fixedly secured relative to the said periphery; and a second, flexible, frustoconical member defining a further base portion, the base portions of the respective frustoconical members being secured together so that the second frustoconical member interconnects the base portion of the first frustoconical member and the body member or a further member adjacent thereto; and the second frustoconical member being moveable relative to the body member at least parallel to the length thereof.

According to a second aspect of the invention there is provided a drillpipe sub comprising a first, flexible, frustoconical member including a securing portion and a base portion that is radially spaced from the securing portion, the securing portion being fixedly securable to an elongate body member; and a second, flexible, frustoconical member defining an engaging portion and a further base portion, the said engaging portion being moveably engageable with an elongate body member and the base portions of the respective frustoconical members being secured together.

During movement of the sub along a drillpipe, the second frustoconical member supports the base portion of the first frustoconical member. This prevents the outer periphery (base portion) of the first said member from turning inside out or rotating relative to a drillpipe in which it is used. This is at least partly because the moveability in use of the second frustoconical member relative to the first frustoconical member balances the fluid pressure on each side of the second frustoconical member with the fluid pressure behind the first frustoconical member.

The flexibility of the frustoconical members permits the diameter of the sub at its widest part to adjust. The sub of the invention may be designed so that its outermost periphery seals a drillpipe; or so as merely to create sufficient resistance to fluid flow to permit pumping of the sub along the drillpipe.

When the sub of the invention is configured as defined in claim 1 (ie. including an elongate sub body) defining at least one sub body outer periphery, preferably the securing portion encircles the said outer periphery and is sealingly secured thereto.

This arrangement permits the designer of a sub according to the invention to choose whether the base of the first frustoconical member is intended to seal around the interior of the drillpipe; or permit limited flow of fluid.

In another arrangement the securing portion may be arranged to permit limited flow of fluid, via the outer periphery of the elongate sub body. This provides further flow control options.

Optionally, when the second frustoconical member interconnects the base of the first frustoconical member and a further member that lies adjacent the elongate body member, the said further member is moveable relative to the elongate body member and the second frustoconical member is secured to the said further member.

In preferred embodiments a sub body is transversely divided into two parts, that are moveable one relative to the other, to define respectively the elongate body member and the further member.

Preferably the further member is engageable with the elongate body member to limit movement of the second frustoconical member relative to the elongate body member.

This arrangement is particularly convenient when the elongate body member and the further member are formed by dividing a sub body as aforesaid, since as a result the diameters of the elongate body member and the further member are the same. This facilitates abutment of the elongate and further members together; and allows the dimensions of the first and second frustoconical members to be essentially the same.

Preferably at least the first frustoconical member, and in practice each of the frustoconical members, defines a hollow interior.

When the second, frustoconical member has a hollow interior it preferably is perforated thereby permitting balancing of fluid pressure within the hollow interior thereof with fluid pressure external thereto. This arrangement is an advantageously simple one for providing balancing of pressure on either side of the second, frustoconical member.

In another embodiment one or more of the frustoconical members may have a cellular (eg. spongy) structure.

In any event, while the flexibility of the frustoconical members confers on the sub of the invention the ability to adapt to variations in drillpipe diameters and fluid pressures, it is advantageous for the material of at least one of the frustoconical members to be resiliently deformable.

At least the first, and in preferred embodiments each, frustoconical member may include resiliently deformable folding portions that permit dilation and contraction of the frustoconical members, for example in a manner similar to that of an iris diaphragm. Preferably the material of the frustoconical members has "memory", ie. on removal of a deforming force it returns to a preformed shape.

The provision of resilient folding portions is particularly advantageous when the drillpipe sub is used in a tapered drillpipe. During movement of the sub in the tapered drillpipe, the resilient folding portions allow the frustoconical members to contract at their bases in response to a decrease in the diameter of the drillpipe while still maintaining a pressure seal.

The resilient nature of the folding portions is such that on movement of the sub from a small diameter to a large diameter drillpipe the frustoconical members dilate at their bases as the diameter of the drillpipe increases.

The resiliently deformable folding portions may be defined by a recess, formed in a wall of a said frustoconical member, that encourages adjacent sections of the said frustoconical member to overlap one another. This may be achieved by providing an angled face at the base of each recess.

DESCRIPTION OF THE DRAWINGS

Preferred embodiments of the invention will now be described by way of non-limiting example, with reference to the accompanying drawings in which.

DETAILED DESCRIPTION OF THE INVENTION

Figure 1:
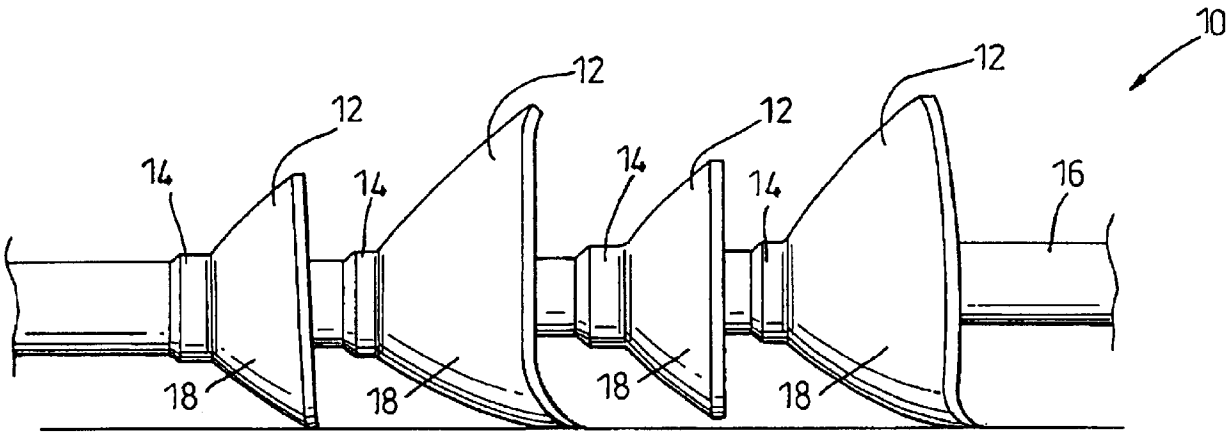
Fig. 1 (Prior Art)
FIGS. 1 and 2 show a prior art drillpipe sub having four conventional swab cups mounted thereon.
Figure 2:
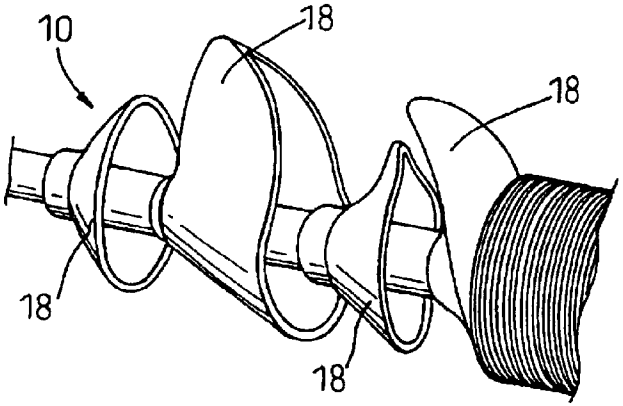
Fig 2 (Prior Art)

A drillpipe sub 30 according to the invention includes a body member in the form of elongate shaft 32, a first frustoconical member 34 encircling, and fixedly mounted on the shaft 32, and a second, frustoconical member 36 encircling, and slidably mounted on the shaft 32. The first and second frustoconical members 34,36 are bonded together at their bases 38,40 that are in the embodiment shown of the same diameter.

The first and second frustoconical members 34,36 are manufactured from a resiliently deformable material.

The frustoconical members 34, 36 are hollow.

The first frustoconical member 34 is fixedly mounted on the shaft 32 by means of a sleeve 42 secured to the end of the member 34 that is remote from base 38. The sleeve 42 is sealingly secured around the periphery of the shaft 32 by a fixing means such as (but not limited to) a worm drive pipe clip, a resiliently deformable clip, an adhesive sealing compound or a bonding agent The second frustoconical member 36 also includes a sleeve 44 secured to the end of the cone frustum remote from base 40. Clearance between the periphery of the shaft 32 and the sleeve 44 permits the second frustoconical member 36 to move eg. by sliding along the shaft 32. Such movement of the second frustoconical member 36 along the shaft 32 is limited by the bonding together of the bases of the frustoconical members 34, 36 about their periphery.

The sub of the invention may also include further means for limiting the travel of the sleeve 44 along the shaft 32. For example sleeve 44 may include inserted fixedly therein and encircling shaft 32 a hollow metal lining cylinder 43. Mutually spaced members protruding from shaft 32 could then serve to limit the travel of the sleeve 44, by virtue of the cylinder 43 abutting the members at the ends of its movement.

Figure 6:
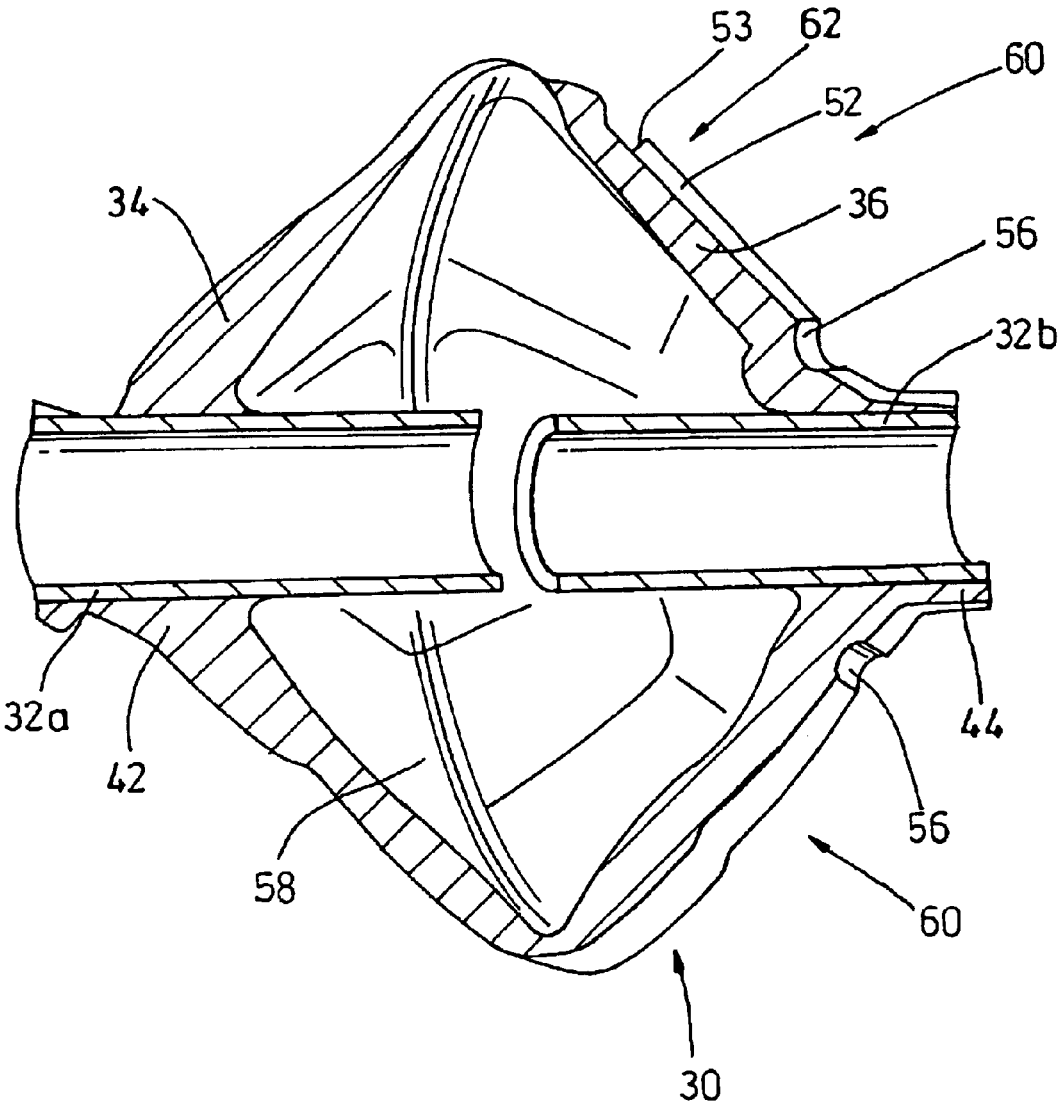
FIG. 6 is a longitudinally cross-sectioned view of a drillpipe sub according to the invention.

Another way of achieving limited movement of the second, frustoconical member relative to the first is shown in FIG. 6, that shows an embodiment of the invention in longitudinal sectional view.

In the FIG. 6 arrangement the (eg. metal) shaft 32 is transversely divided so as to form respectively an elongate body member part 32*a* and a further member 32*b*. In the embodiment shown the members 32*a*, 32*b* are as a result both of the same hollow, cylindrical cross-section but this need not necessarily be so.

Figure 3:
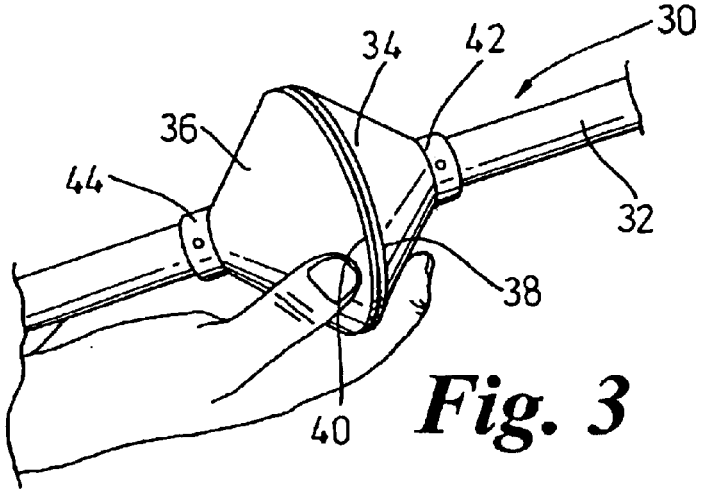
FIG. 3 shows a drillpipe sub according to the invention.

The frustoconical members 34, 36 visible in FIG. 6 are essentially the same as the members 34, 36 visible eg. in FIG. 3. However, in the FIG. 6 embodiment the sleeve 44 of the second frustoconical member is bonded to member 32*b* in like manner to the bonding of sleeve 42 to body 32*a*.

Moveability of sleeve 44 relative to body member 32*a* occurs as a result of movement of member 32*b* towards and away from body member 32*a*, parallel to the elongate axis thereof, instead of by sliding of sleeve 44 relative to a shaft.

As further member 32*b* moves closer to body member 32*a*, the diameter of the sub 30 increases, by virtue of the joining of the resiliently deformable frustoconical members 34, 36 around their abutting base peripheries. Expansion of the sub 30 in this way is limited to a maximum when further member 32*b* engages body member 32*a*.

FIG. 6 also shows through-going apertures 56 perforating the wall of second frustoconical member 36 for the purpose of equalising fluid pressure in the hollow chamber 58, defined within the sub, with fluid pressure in the region 60 to the rear of the sub 30.

FIG. 6 also shows at 62 a recess 52 (described in more detail below) that assists the sub 30 to expand and contract. The base of recess 52 includes at least one angled face 53 that encourages contraction of the sub 30.

The apertures 56 are sized to permit rapid expulsion of fluid from chamber 58 when the sub 30 contracts eg. at a drillpipe diameter reduction. The apertures thus have a function in preventing bursting of the sub as a result of overpressure in chamber 58.

When the sub 30 shown in FIG. 3 is used to form part of an hydraulic actuator for transporting apparatus along a borehole in the downhole direction, the shaft 32 is inserted into a drillpipe such that the cone frustum defined by the first frustoconical member 34 tapers in a downhole direction.

The diameter of the base 38, 40 of each frustoconical member 34,36 is chosen so that their peripheral edges lie closely adjacent or in some embodiments sealing against the inner surface of the drillpipe. When fluid pressure (e.g. of drilling mud etc) in the drillpipe acts on the second frustoconical member 36, a pressure differential is created across the first frustoconical member 34. The pressure differential in turn pumps the sub in a downhole direction.

During movement in the downhole direction, the slidable mounting of the sleeve 44 enables the fluid pressure on each side of the second frustoconical member 36 to balance with the fluid pressure behind the first frustoconical member 34. The second frustoconical member 36 can therefore support and maintain the base 38 of the first frustoconical member 34 in position. The second frustoconical member 36 thereby resists the tendency of the first frustoconical member 34 to turn inside out, or to rotate relative to the drillpipe.

During testing, a sub, constructed in accordance with the embodiment of the invention that is shown in FIG. 3 for a drillpipe having a diameter of 70 mm (2.75"), withstood a differential pressure of 517 kPa (750 psi). This equates to an axial load of 20,016N (4,500 lbs).

A fluid flow restricting device, constructed in accordance with the embodiment of the invention that is shown in FIG. 3 for a drillpipe having a diameter of 108 mm (4.25"), withstood a differential pressure of 1724 kPa (250 psi). This equates to an axial load of 13,344N (3,000 lbs).

It is possible within the scope of the invention to construct a drillpipe sub that is in essence a mirror image of the FIG. 3 embodiment. Such a sub is pumpable in the uphole direction along a drillpipe.

When the sub 30 is used in a tapered drillpipe, one or more further pairs of opposed, frustoconical members may be mounted on the shaft 32 having bases of varying diameters.

As the sub enters successively narrower drillpipe stands the trailing (second) frustoconical member 36 of one or more of the pairs moves away from its associated leading (first) frustoconical member 34, to allow the bases of the frustoconical members to accommodate the drillpipe diameter changes.

While the sub 30 shown in FIG. 3 forms part of an hydraulic actuator, the sub 30 may be used in many other drillpipe sub applications.

Figure 4:
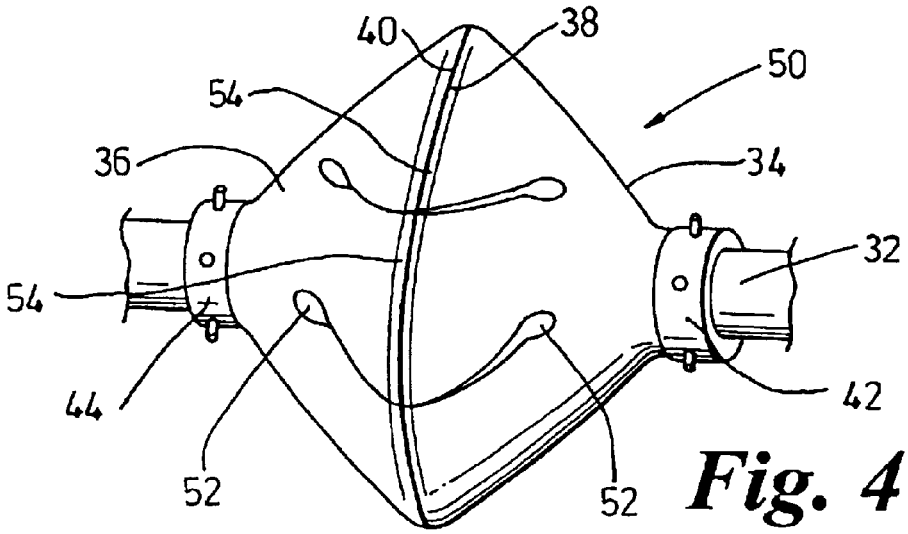
FIGS. 4 and 5 show a drillpipe sub according to another embodiment of the invention.

In other embodiments of the invention, the first and second frustoconical members 34,36 may be formed integrally with one another. One such sub 50 is shown in FIGS. 4 and 5.

The sub 50 includes a series of recesses 52 formed in the first and second frustoconical members 34,36. The recesses 52 are equidistantly spaced around the circumference of the frustoconical members 34,36 separating adjacent sections 54 of the members 34,36.

Figure 5:
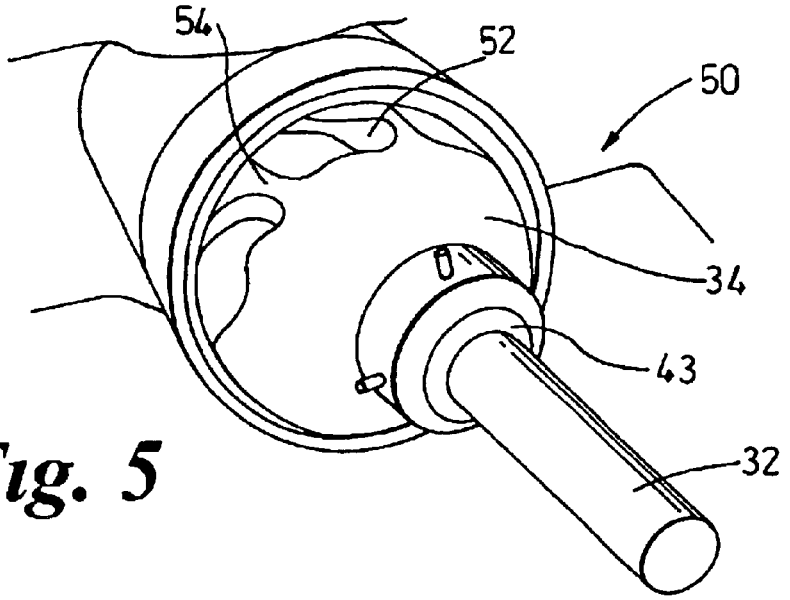

When the drillpipe sub 50 moves through a tapered drillpipe, the recesses 52 allow adjacent sections 54 of the frustoconical members 34,36 to fold over each other as the diameter of the drillpipe diameter decreases (FIG. 5). This allows the first and second frustoconical members 34,36 to contract at their bases 38,40.

The resilient nature of the material from which the first and second frustoconical members 34,36 are manufactured means that on movement of the sub 50 from a narrow to a wider drillpipe stand, the frustoconical members 34,36 dilate at their bases 38,40.

The ability of the sub 50 to contract and dilate in a manner similar to that of an iris diaphragm significantly reduces frictional forces that may arise between the frustoconical members 34,36 and the inner surface of a tapered drillpipe as the diameter of the drillpipe decreases.

The invention also embraces within its scope an arrangement similar to those shown in FIG. 3, FIG. 6 or in FIGS. 4 and 5, but omitting the shaft 32. Such an assembly constitutes a module that is securable to a sub body member for the purpose of converting the body member to the configuration exemplified by eg. FIG. 3 or FIG. 6.

Although the above-described embodiments of the invention include frustoconical members that, when assembled onto the shaft 32, taper in opposite directions, in other embodiments of the invention the respective frustoconical members could be inserted one into the other so that they taper in the same direction.

Furthermore the connection between the bases 38, 40 may include one or more intermediate members such as a bellows or a rigid or flexible annulus.

Features of the sub of the invention illustrated herein in connection with one embodiment may if desired be included in others of the embodiments. Thus for example the apertures 56 and recesses 52 may be present in any of the embodiments; and the sleeve 44 of FIG. 6 may if desired be as shown in FIG. 5 to give rise to a hybrid embodiment.

Also the components of the invention may be manufactured from a range of materials.

For example the shafts 32, 32*a* and 32*b* may be made from any of a range of metals or other rigid materials such as plastics or composite materials.

The frustoconical members are manufacturable from a variety of resiliently deformable materials such as but not limited to rubberised materials. Such materials may include reinforcing elements as desired.

We claim:

1. A drillpipe sub comprising an elongate body member defining at least one outer periphery; a first, flexible, frustoconical member including a securing portion and a base portion that is radially spaced from the securing portion, the securing portion being fixedly secured relative to the said periphery; and a second, flexible, frustoconical member defining a further base portion, the base portions of the respective frustoconical members being secured together so that the second frustoconical member interconnects the base portion of the first frustoconical member and the body member or a further member adjacent thereto; and the second frustoconical member being moveable relative to the body member at least parallel to the length thereof.

2. A drillpipe sub according to claim 1 wherein the securing portion encircles the said outer periphery and is sealingly secured thereto.

3. A drillpipe sub according to claim 1 or claim 2 wherein when the second frustoconical member interconnects the base of the first frustoconical member and a further member that lies adjacent the elongate body member, the said further member is moveable relative to the elongate body member and the second frustoconical member is secured to the said further member.

4. A drillpipe sub according to claim 3 wherein the further member is engageable with the elongate body member to limit movement of the second frustoconical member relative to the elongate body member.

5. A drillpipe sub comprising a first, flexible, frustoconical member including a securing portion and a base portion that is radially spaced from the securing portion, the securing portion being fixedly securable to an elongate body member; and a second, flexible, frustoconical member defining an engaging portion and a further base portion, the said engaging portion being moveably engageable with an elongate body member and the base portions of the respective frustoconical members being secured together.

6. A drillpipe sub according to any one of claims 1, 2, and 5 wherein the first frustoconical member defines a hollow interior.

7. A drillpipe sub according to any one of claims 1, 2, and 5 wherein the second frustoconical member defines a hollow interior.

8. A drillpipe sub according to claim 7 wherein the second frustoconical member is perforated thereby permitting balancing of fluid pressure within the hollow interior thereof with fluid pressure external thereto.

9. A drillpipe sub according to any one of claims 1, 2, and 5 wherein at least one of the said first and second frustoconical members is formed of or includes a resiliently deformable material.

10. A drillpipe sub according to any one of claims 1, 2, and 5 wherein at least the first frustoconical member includes one or more resiliently deformable folding portions that assist dilation and contraction of the frustoconical members.

11. A drillpipe sub according to claim 10 wherein the second frustoconical member includes one or more said resiliently deformable, folding portions.

12. A drillpipe sub according to claim 10 wherein the or each said resiliently deformable, folding portion is defined by a recess, formed in a wall of a said frustoconical member, that allows adjacent sections of the said frustoconical member to overlap one another.

13. A drillpipe sub according to claim 12 wherein the or each said recess includes an angled face that encourages overlapping of adjacent sections of the said frustoconical member.

* * * * *